US010903563B2

(12) United States Patent
Kang et al.

(10) Patent No.: US 10,903,563 B2
(45) Date of Patent: Jan. 26, 2021

(54) COMMUNICATION DEVICE

(71) Applicant: MEDIATEK INC., Hsin-Chu (TW)

(72) Inventors: Ting-Wei Kang, Hsin-Chu (TW); Shih-Huang Yeh, Hsin-Chu (TW); Chen-Fang Tai, Hsin-Chu (TW)

(73) Assignee: MEDIATEK INC., Hsin-Chu (TW)

( * ) Notice: Subject to any disclaimer, the term of this patent is extended or adjusted under 35 U.S.C. 154(b) by 14 days.

(21) Appl. No.: 16/398,455

(22) Filed: Apr. 30, 2019

(65) Prior Publication Data

US 2020/0350671 A1 Nov. 5, 2020

(51) Int. Cl.
*H01Q 1/44* (2006.01)
*H01Q 1/24* (2006.01)

(52) U.S. Cl.
CPC ..... *H01Q 1/44* (2013.01); *H01Q 1/243* (2013.01)

(58) Field of Classification Search
None
See application file for complete search history.

(56) References Cited

U.S. PATENT DOCUMENTS

2017/0294705 A1* 10/2017 Khripkov ..... H01Q 21/24

* cited by examiner

*Primary Examiner* — Jany Richardson
(74) *Attorney, Agent, or Firm* — McClure, Qualey & Rodack, LLP

(57) ABSTRACT

The invention is directed to a communication device. The communication device includes a millimeter-wave antenna array and an appearance metal element. The appearance metal element has an antenna window. The millimeter-wave antenna array is configured to transmit or receive a wireless signal. The wireless signal is transferred through the antenna window of the appearance metal element.

20 Claims, 8 Drawing Sheets

COMMUNICATION DEVICE

BACKGROUND OF THE INVENTION

Field of the Invention

The disclosure generally relates to a communication device, and more particularly, it relates to a communication device with an antenna window.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

In order to improve their appearance, designers often incorporate metal elements into mobile devices. However, these newly-added metal elements tend to negatively affect the operation of antennas used for wireless communication in mobile devices, thereby degrading the overall communication quality of the mobile devices. As a result, there is a need to propose a solution for solving the problems of the prior art.

BRIEF SUMMARY OF THE INVENTION

In an exemplary embodiment, the disclosure is directed to a communication device. The communication device includes a millimeter-wave antenna array and an appearance metal element. The appearance metal element has an antenna window. The millimeter-wave antenna array is configured to transmit or receive a wireless signal. The wireless signal is transferred through the antenna window of the appearance metal element.

In some embodiments, the communication device is a mobile phone, a tablet computer, or a notebook computer.

In some embodiments, the appearance metal element is a frame, a bezel, a ring, or the back cover of the communication device.

In some embodiments, the radiation direction of the millimeter-wave antenna array is toward the antenna window.

In some embodiments, the millimeter-wave antenna array is configured to generate end-fire radiation.

In some embodiments, the millimeter-wave antenna array is disposed on a PCB (Printed Circuit Board).

In some embodiments, the shape of the antenna window is adjusted according to the shape of the millimeter-wave antenna array.

In some embodiments, the antenna window includes at least one opening formed through the appearance metal element.

In some embodiments, the opening of the antenna window substantially has a square shape, a rectangular shape, a circular shape, a triangular shape, or an irregular shape.

In some embodiments, the millimeter-wave antenna array has a vertical projection on the appearance metal element, and the whole vertical projection is inside the opening.

In some embodiments, the antenna window includes a first opening and a second opening formed through the appearance metal element, and the appearance metal element has a right-angle bending portion positioned between the first opening and the second opening.

In some embodiments, both the first opening and the second opening extend to an edge of the appearance metal element.

In some embodiments, neither the first opening nor the second opening touches any edge of the appearance metal element.

In some embodiments, the antenna window is filled with a nonconductive material.

In some embodiments, the nonconductive material is a plastic material, a glass material, or air.

In some embodiments, the antenna window substantially has a fence-shape.

In some embodiments, the antenna window includes a plurality of hollow portions and a plurality of metal portions, and the hollow portions and the metal portions are interleaved with each other.

In some embodiments, the appearance metal element is used as an auxiliary antenna structure.

In some embodiments, the auxiliary antenna structure is a sub-6 GHz antenna structure or a legacy antenna structure.

In some embodiments, the shape of the antenna window is adjusted according to the shape of the auxiliary antenna structure.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
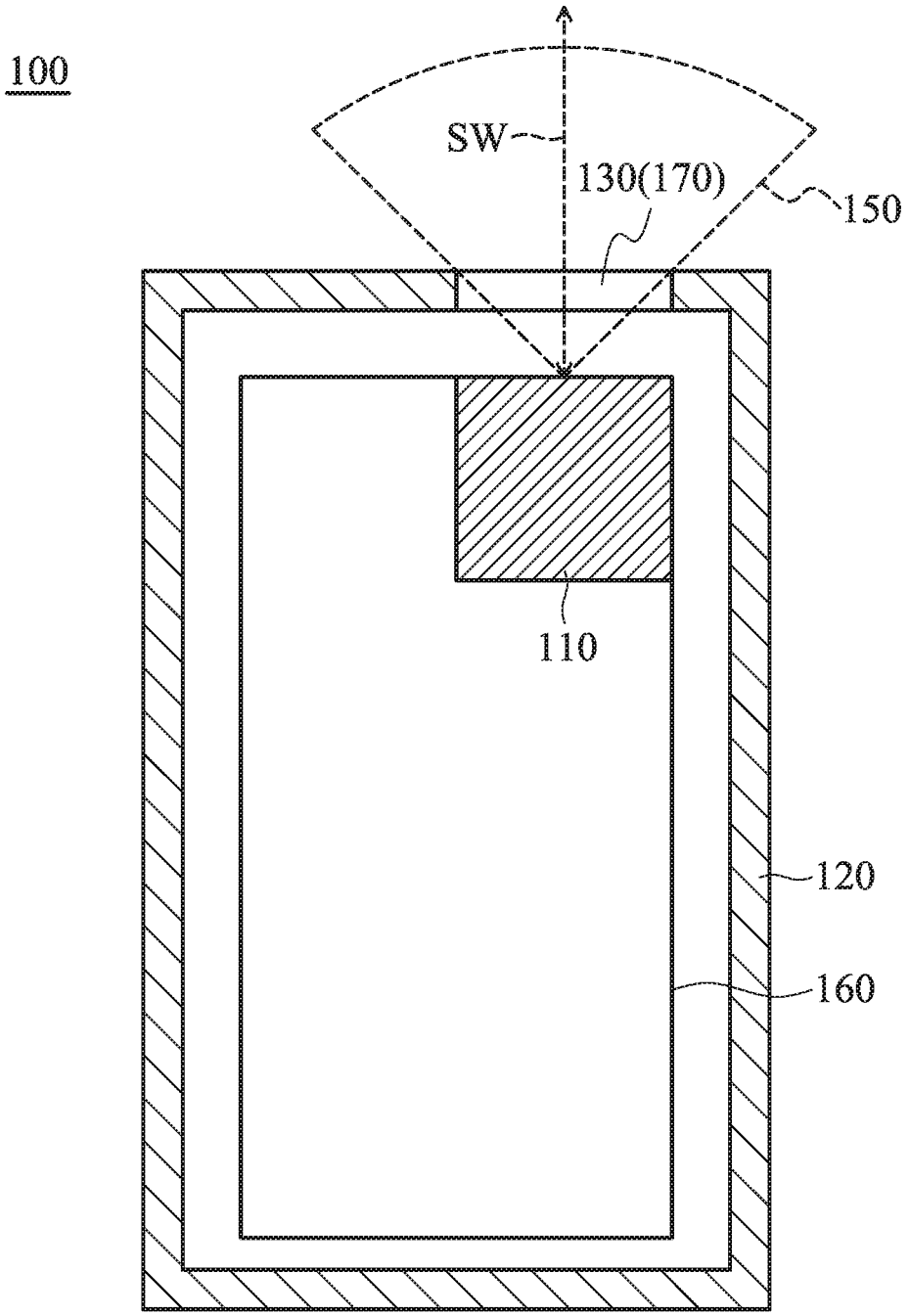
FIG. 1 is a sectional view of a communication device according to an embodiment of the invention.

FIG. 1 is a sectional view of a communication device 100 according to an embodiment of the invention. For example, the communication device 100 may be a mobile phone, a tablet computer, or a notebook computer, but it is not limited thereto. As shown in FIG. 1, the communication device 100 at least includes a millimeter-wave antenna array 110 and an appearance metal element 120. It should be understood that the communication device 100 may further include other components, such as a touch control panel, a processor, a battery, a speaker, and/or a housing, although they are not displayed in FIG. 1.

The type and shape of the millimeter-wave antenna array 110 are not limited in the invention. For example, the millimeter-wave antenna array 110 may include a plurality of antenna elements for covering a millimeter-wave frequency band. In some embodiments, the millimeter-wave antenna array 110 is disposed on a PCB (Printed Circuit Board) 160. In alternative embodiments, the millimeter-wave antenna array 110 is disposed on an antenna holder or any part of the communication device 100. The millimeter-wave antenna array 110 is adjacent to the appearance metal element 120. It should be noted that the term "adjacent" or "close" over the disclosure means that the distance (spacing) between two corresponding elements is shorter than a predetermined distance (e.g., 10 mm or shorter).

The so-called "appearance metal element 120" is defined as an external portion of the communication device 100, and the aforementioned external portion can be directly observed by eyes of a user. The millimeter-wave antenna array 110 may be disposed inside appearance metal element 120 and surrounded by the appearance metal element 120. In some embodiments, the appearance metal element 120 is a frame, a bezel, or a ring of the communication device 100. In alternative embodiments, the appearance metal element 120 is a back cover or a plate of the communication device 100. The appearance metal element 120 has an antenna window 130. The antenna window 130 may be a non-metal region filled with a nonconductive material 170. For example, the nonconductive material 170 may be a plastic material, a glass material, or air, but it is not limited. Specifically, if the millimeter-wave antenna array 110 is configured to generate end-fire radiation, the radiation direction of the millimeter-wave antenna array 110 will be arranged toward the antenna window 130, such that the radiation pattern 150 of the millimeter-wave antenna array 110 will not be blocked by the appearance metal element 120. In other words, the millimeter-wave antenna array 110 is configured to transmit or receive a wireless signal SW, and the wireless signal SW can be transferred/transmitted through the antenna window 130 of the appearance metal element 120, so as to improve the communication quality of the communication device 100.

Figure 2A:
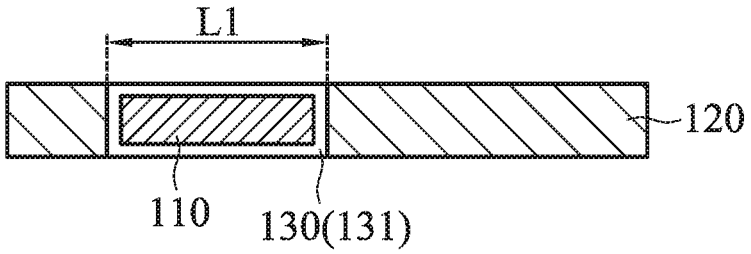
FIG. 2A is a top view of a communication device according to an embodiment of the invention.

FIG. 2A is a top view of the communication device 100 according to an embodiment of the invention. In the embodiment of FIG. 2A, the antenna window 130 includes at least one opening 131 formed through the appearance metal element 120. As mentioned above, the opening 131 may be filled of the nonconductive material 170. The shape of the antenna window 130 is adjusted according to the shape of the millimeter-wave antenna array 110. For example, the opening 131 of the antenna window 130 may substantially have a square shape, a rectangular shape, a circular shape, a triangular shape, or an irregular shape, but it is not limited thereto. If the millimeter-wave antenna array 110 has a vertical projection on the appearance metal element 120, the whole vertical projection of millimeter-wave antenna array 110 may be inside the opening 131 of the antenna window 130, so as to prevent the appearance metal element 120 from negatively affecting the radiation pattern 150 of the millimeter-wave antenna array 110.

Figure 2B:
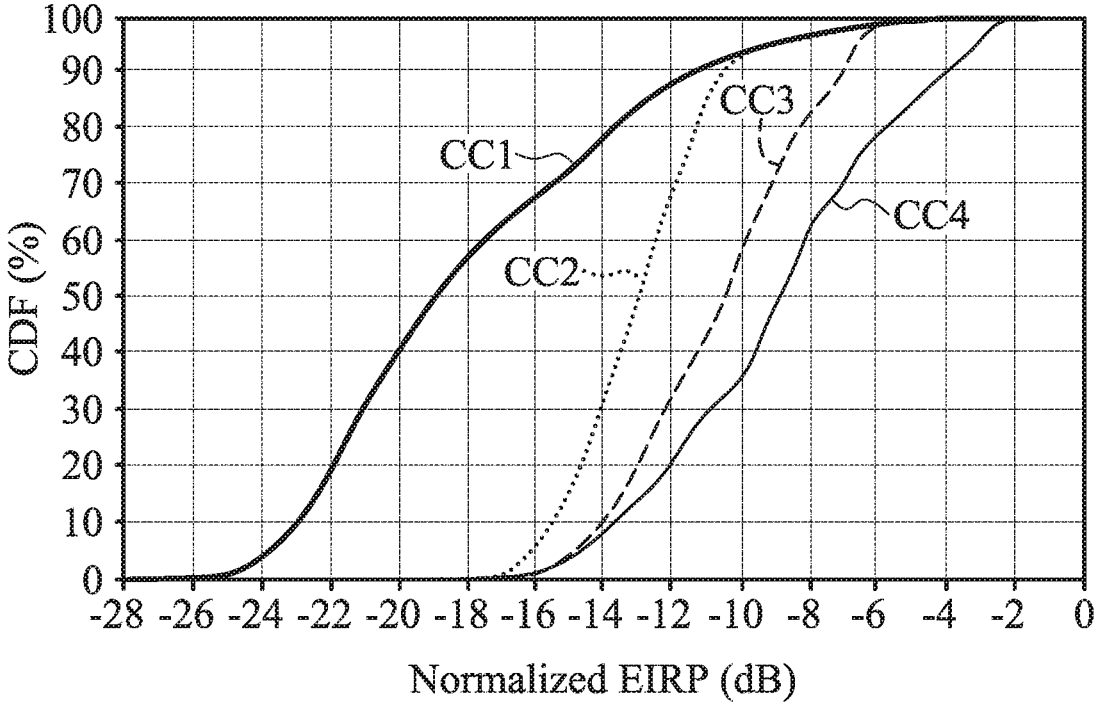
FIG. 2B is a diagram of probability distribution relative to a millimeter-wave antenna array of a communication device according to an embodiment of the invention.

FIG. 2B is a diagram of probability distribution relative to the millimeter-wave antenna array 110 of the communication device 100 according to an embodiment of the invention. The horizontal axis represents the normalized EIRP (Effective Isotropic Radiated Power) of the millimeter-wave antenna array 110. The vertical axis represents the CDF (Cumulative Distribution Function) relative to the millimeter-wave antenna array 110. As shown in FIG. 2B, a first curve CC1 represents the operation characteristic of the millimeter-wave antenna array 110 when the length L1 of the opening 131 of the antenna window 130 is equal to 0 mm (i.e., no antenna window is used), a second curve CC2 represents the operation characteristic of the millimeter-wave antenna array 110 when the length L1 of the opening 131 of the antenna window 130 is equal to 6.5 mm, a third curve CC3 represents the operation characteristic of the millimeter-wave antenna array 110 when the length L1 of the opening 131 of the antenna window 130 is equal to 12.5 mm, and a fourth curve CC4 represents the operation characteristic of the millimeter-wave antenna array 110 when the length L1 of the opening 131 of the antenna window 130 is equal to 21.5 mm. According to the measurement of FIG. 2B, if the length L1 of the opening 131 of the antenna window 130 become longer, the millimeter-wave antenna array 110 will have better radiation performance.

Figure 3A:
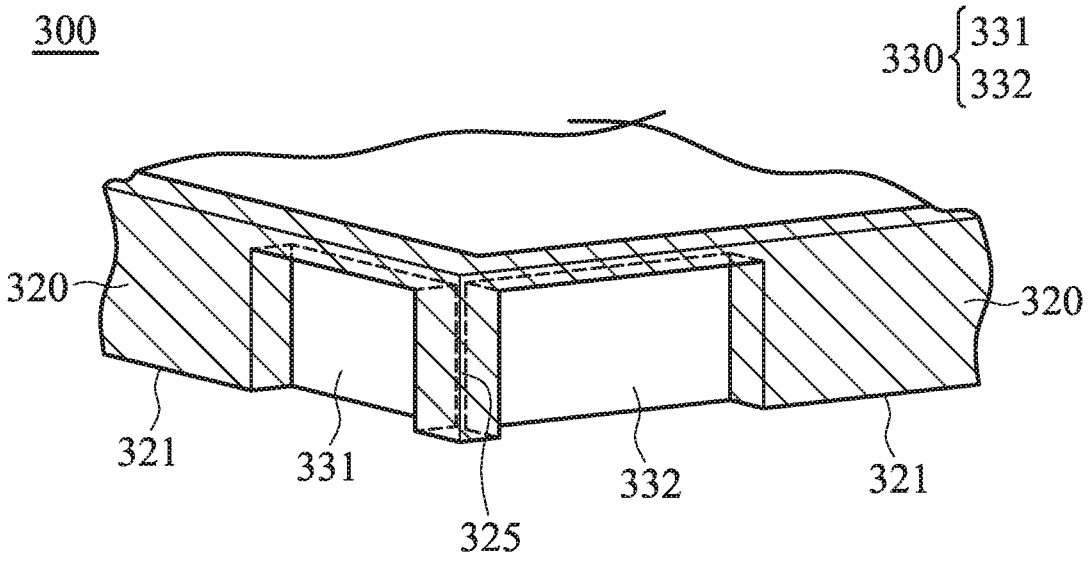
FIG. 3A is a perspective view of a communication device according to an embodiment of the invention.
Figure 3B:
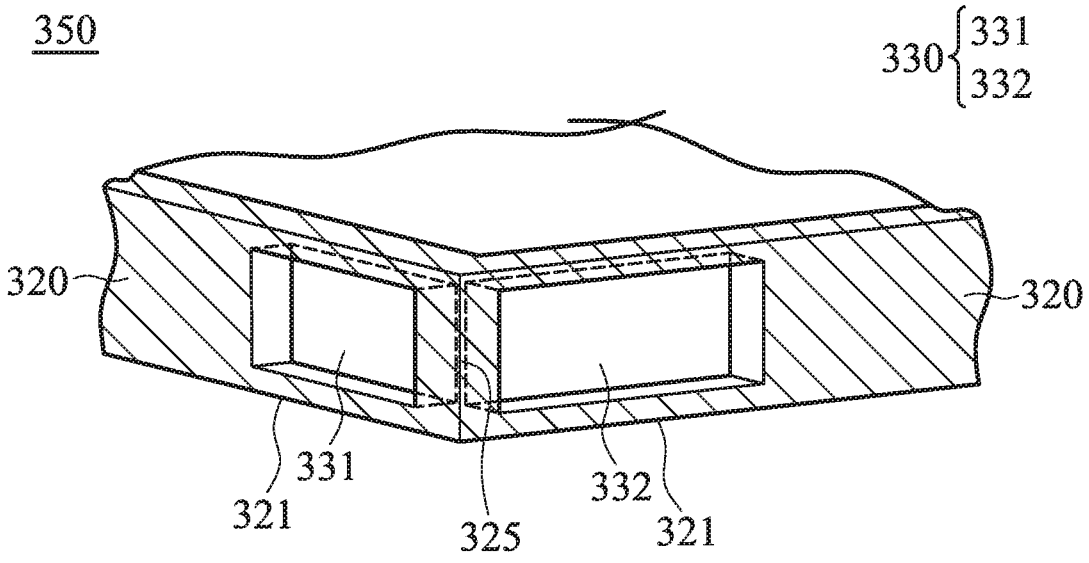
FIG. 3B is a perspective view of a communication device according to another embodiment of the invention.

FIG. 3A is a perspective view of a communication device 300 according to an embodiment of the invention. FIG. 3A is similar to FIG. 1. In the embodiment of FIG. 3A, an antenna window 330 includes a first opening 331 and a second opening 332 formed through an appearance metal element 320 of the communication device 300. The first opening 331 and the second opening 332 are completely separate from each other, and their shapes are not limited in the invention. Specifically, the appearance metal element 320 has a right-angle bending portion 325 positioned between the first opening 331 and the second opening 332. If the millimeter-wave antenna array (not shown) of the communication device 300 have multiple radiation directions, these radiation directions may be arranged toward the first opening 331 and the second opening 332, respectively. As shown in FIG. 3A, both the first opening 331 and the second opening 332 extend to an edge 321 of the appearance metal element 320, so as to form two notches on the edge 321. Since the size of the antenna window 330 of the appearance metal element 320 is relatively large, such a design can improve the radiation performance of the millimeter-wave antenna array of the communication device 300. FIG. 3B is a perspective view of a communication device 350 according to another embodiment of the invention. FIG. 3B is similar to FIG. 3A. In the embodiment of FIG. 3B, the first opening 331 and the second opening 332 have relatively small sizes, and neither the first opening 331 nor the second opening 332 touches any edge of the appearance metal element 320. Since there is no cutting point formed through the appearance metal element 320, such a design can enhance the robustness of the appearance metal element 320 of the communication device 350. Other features of the communication devices 300 and 350 of FIG. 3A and FIG. 3B are similar to those of the communication device 100 of FIG. 1. Therefore, these embodiments can achieve similar levels of performance.

Figure 4A:
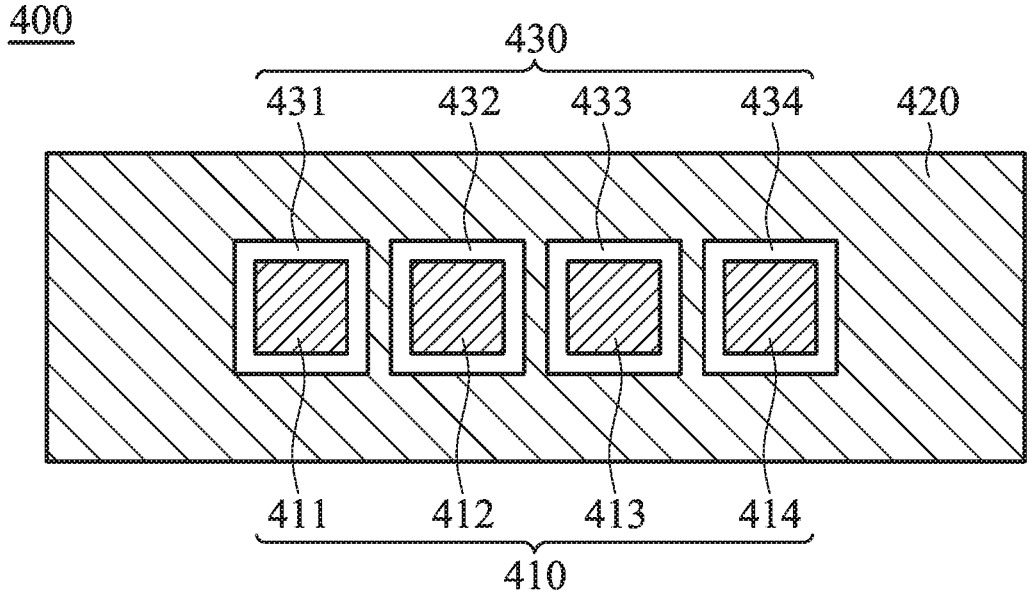
FIG. 4A is a top view of a communication device according to an embodiment of the invention.

FIG. 4A is a top view of a communication device 400 according to an embodiment of the invention. FIG. 4A is similar to FIG. 1. In the embodiments of FIG. 4A, a millimeter-wave antenna array 410 of the communication device 400 includes a first antenna element 411, a second antenna element 412, a third antenna element 413, and a fourth antenna element 414, whose types are not limited in the invention. For example, each of the above antenna elements may substantially have a square shape. In addition, an antenna window 430 of an appearance metal element 420 of the communication device 400 includes a first opening 431, a second opening 432, a third opening 433, and a fourth opening 434, whose shapes are not limited in the invention. For example, each of the above openings may substantially have a square shape. The first antenna element 411, the second antenna element 412, the third antenna element 413, and the fourth antenna element 414 may be arranged in the same straight-line. The first opening 431, the second opening 432, the third opening 433, and the fourth opening 434 are completely separate from each other. The whole vertical projection of the first antenna element 411 may be inside the first opening 431. The whole vertical projection of the second antenna element 412 may be inside the second opening 432. The whole vertical projection of the third antenna element 413 may be inside the third opening 433. The whole vertical projection of the fourth antenna element 414 may be inside the fourth opening 434. In other words, the shape of the antenna window 430 is adjusted according to the shape of the millimeter-wave antenna array 410. Such a design can prevent the appearance metal element 420 from negatively affecting the radiation pattern of the millimeter-wave antenna array 410.

Figure 4B:
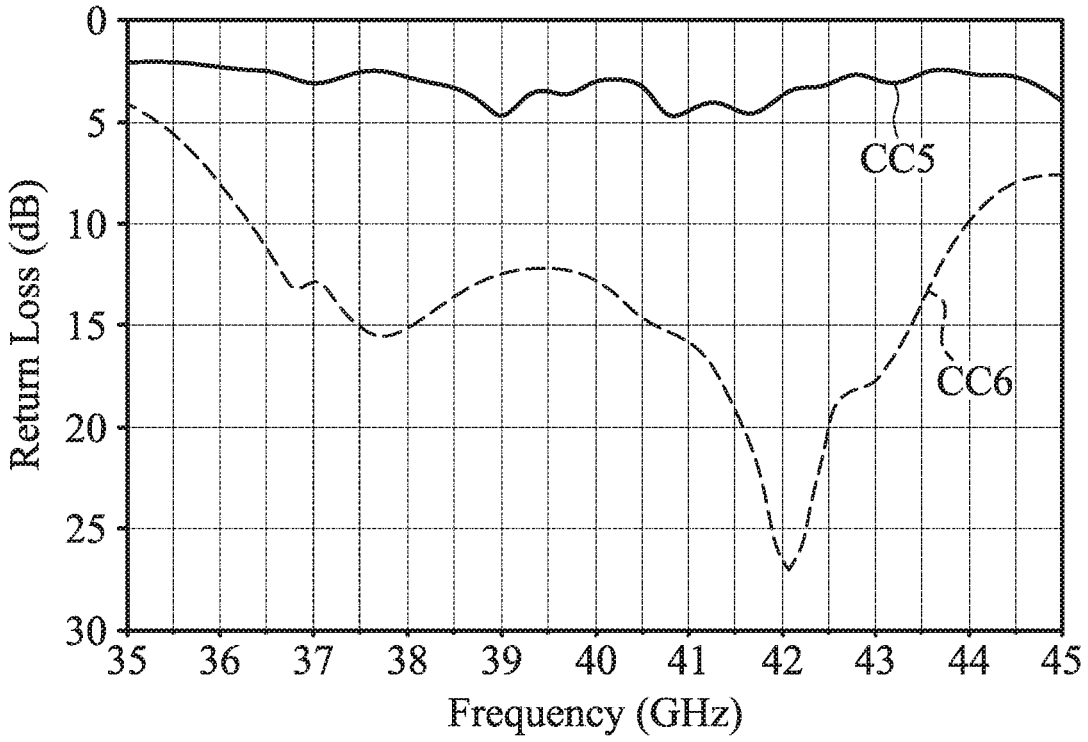
FIG. 4B is a diagram of return loss of a millimeter-wave antenna array of a communication device according to an embodiment of the invention.

FIG. 4B is a diagram of return loss of the millimeter-wave antenna array 410 of the communication device 400 according to an embodiment of the invention. The horizontal axis represents the operation frequency of the millimeter-wave antenna array 410. The vertical axis represents the return loss of the millimeter-wave antenna array 410. As shown in FIG. 4B, a fifth curve CC5 represents the operation characteristic of the millimeter-wave antenna array 410 when no antenna window is used, and a sixth curve CC6 represents the operation characteristic of the millimeter-wave antenna array 410 when the antenna window 430 is used. According to the measurement of FIG. 4B, the newly-added antenna window 430 can significantly increase the operation bandwidth of the millimeter-wave antenna array 410. It should be understood that the total number of openings of the antenna window 430 is adjustable according to different requirements. Other features of the communication device 400 of FIG. 4A are similar to those of the communication device 100 of FIG. 1. Therefore, these embodiments can achieve similar levels of performance.

Figure 5A:
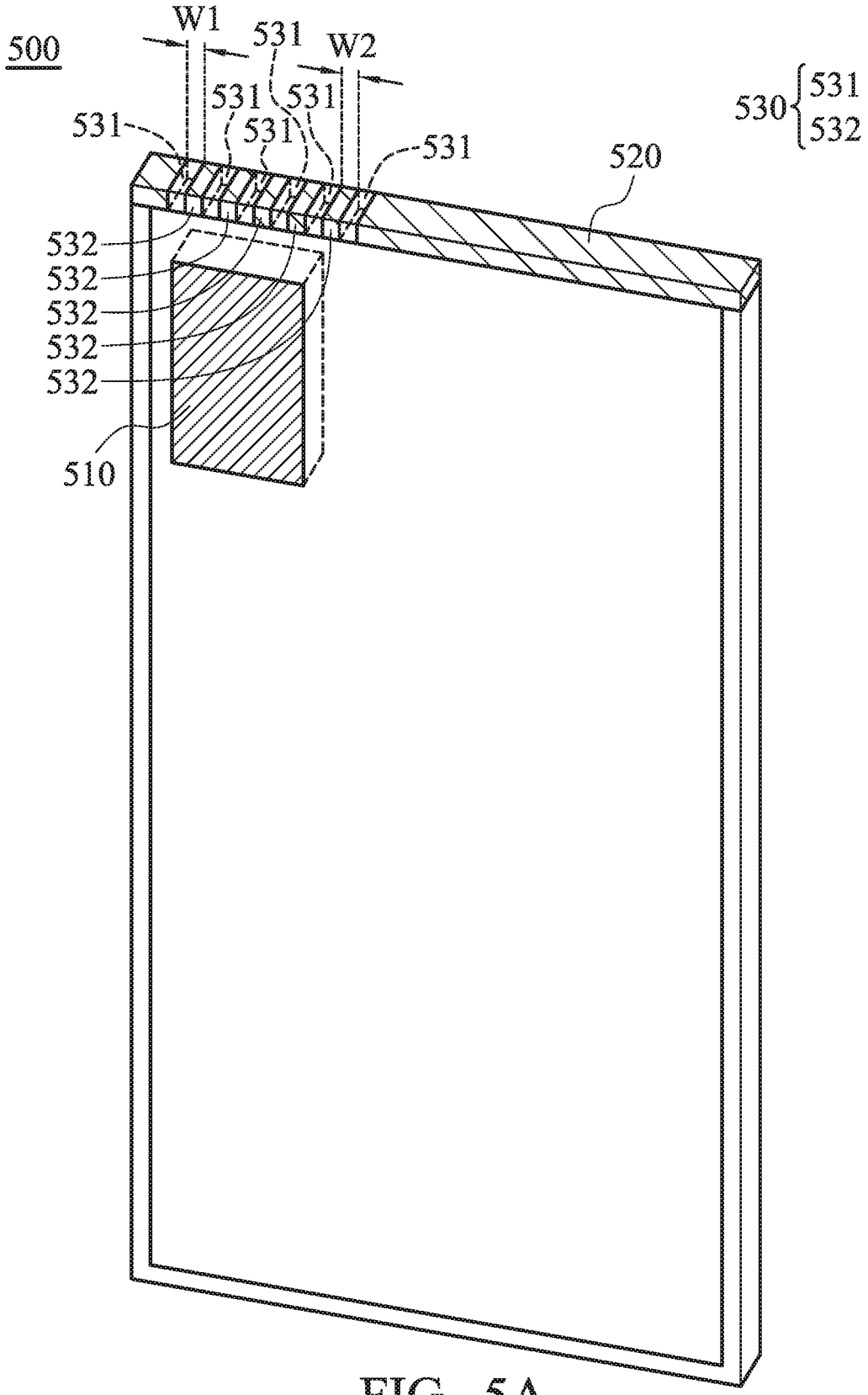
FIG. 5A is a perspective view of a communication device according to another embodiment of the invention.

FIG. 5A is a perspective view of a communication device 500 according to another embodiment of the invention. FIG. 5A is similar to FIG. 1. In the embodiment of FIG. 5A, the communication device 500 includes a millimeter-wave antenna array 510 and an appearance metal element 520, and an antenna window 530 of the appearance metal element 520 substantially has a fence-shape. The radiation direction of the millimeter-wave antenna array 510 is toward the fence-shaped antenna window 530. Specifically, the antenna window 530 includes a plurality of hollow portions 531 and a plurality of metal portions 532, and the hollow portions 531 and the metal portions 532 are interleaved with each other. The vertical projection of the millimeter-wave antenna array 510 may overlap the metal portions 532 of the antenna window 530. The total number of hollow portions 531 and the total number of metal portions 532 are adjustable according to different requirements. In some embodiments, if the millimeter-wave antenna array 510 has an operation frequency, the width W1 of each hollow portion 531 may be substantially equal to 0.25 wavelength ($\lambda/4$) of the operation frequency, and the width W2 of each metal portion 532 may be also substantially equal to 0.25 wavelength ($\lambda/4$) of the operation frequency. The above element sizes are calculated and obtained according to many experiment results, and they help to optimize the operation bandwidth and impedance matching of the millimeter-wave antenna array 510.

Figure 5B:
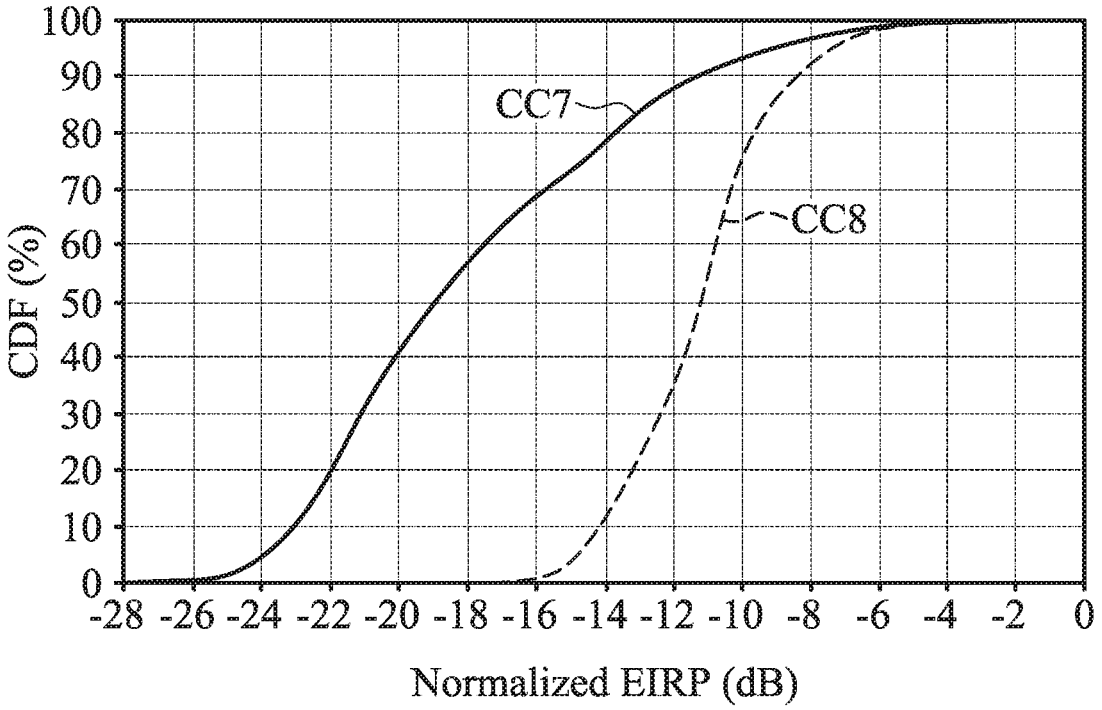
FIG. 5B is a diagram of probability distribution relative to a millimeter-wave antenna array of a communication device according to another embodiment of the invention.

FIG. 5B is a diagram of probability distribution relative to the millimeter-wave antenna array 510 of the communication device 500 according to another embodiment of the invention. The horizontal axis represents the normalized EIRP of the millimeter-wave antenna array 510. The vertical axis represents the CDF relative to the millimeter-wave antenna array 510. As shown in FIG. 5B, a seventh curve CC7 represents the operation characteristic of the millimeter-wave antenna array 510 when no antenna window is used, and an eighth curve CC8 represents the operation characteristic of the millimeter-wave antenna array 510 when the fence-shaped antenna window 530 is used. According to the measurement of FIG. 5B, the fence-shaped antenna window 530 can still prevent the appearance metal element 520 from negatively affecting the radiation pattern of the millimeter-wave antenna array 510. Other features of the communication device 500 of FIG. 5A are similar to those of the communication device 100 of FIG. 1. Therefore, these embodiments can achieve similar levels of performance.

Figure 6:
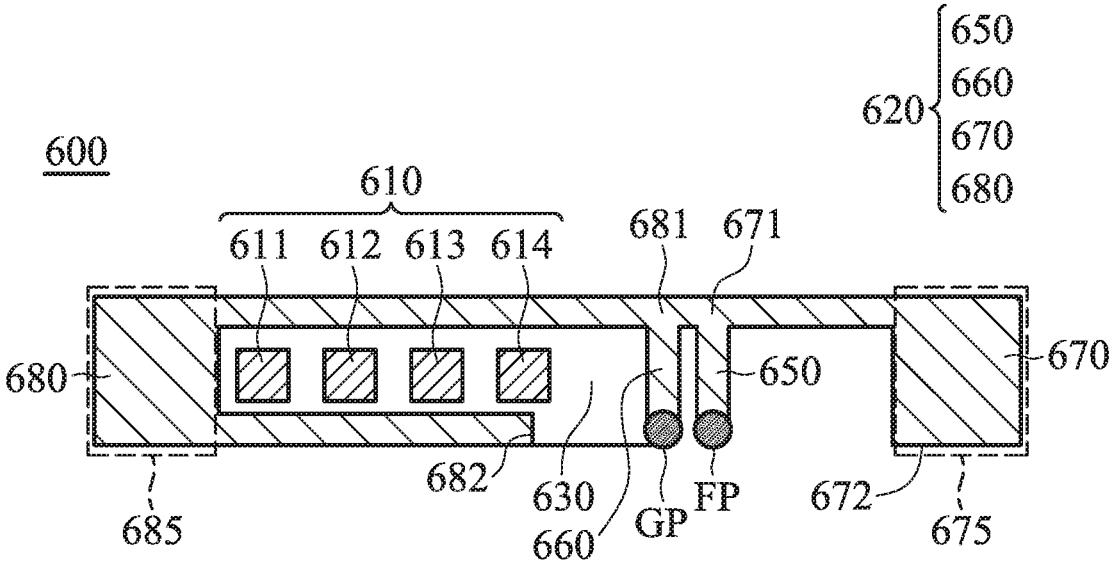
FIG. 6 is a top view of a communication device according to an embodiment of the invention.

FIG. 6 is a top view of a communication device 600 according to an embodiment of the invention. FIG. 6 is similar to FIG. 1. In the embodiment of FIG. 6, the communication device 600 includes a millimeter-wave antenna array 610 and an appearance metal element 620, and the appearance metal element 620 is used as an auxiliary antenna structure. In some embodiments, the auxiliary antenna structure is a sub-6 GHz antenna structure or a legacy antenna structure, whose operation frequency is lower than the operation frequency of the millimeter-wave antenna array 610. In alternative embodiments, the auxiliary antenna structure is a GPS/Bluetooth/Wi-Fi antenna structure. The auxiliary antenna structure has a feeding point FP and a grounding point GP. The feeding point FP may be coupled to a signal source, such as an RF (Radio Frequency) module (not shown). The grounding point GP may be coupled to a ground voltage or a ground element (not shown). The millimeter-wave antenna array 610 includes a first antenna element 611, a second antenna element 612, a third antenna element 613, and a fourth antenna element 614. For example, each of the above antenna elements may be a square patch antenna, but it is not limited thereto. The appearance metal element 620 has an antenna window 630 filled with a nonconductive material. For example, the antenna window 630 may be substantially an L-shaped opening for covering the whole vertical projection of the millimeter-wave antenna array 610. The shape of the antenna window 630 is adjusted according to the shape of the auxiliary antenna structure. Specifically, the appearance metal element 620 includes a feeding element 650, a shorting element 660, a first radiation element 670, and a second radiation element 680. The feeding element 650 may substantially have a straight-line shape. The feeding element 650 is coupled to the feeding point FP. The shorting element 660 may substantially have a straight-line shape, whose length may be the same as the length of the feeding element 650. The shorting element 660 is coupled to the grounding point GP. The first radiation element 670 may substantially have an L-shape. The first radiation element 670 has a first end 671 and a second end 672. The first end 671 of the first radiation element 670 is coupled to the feeding element 650. The second end 672 of the first radiation element 670 is an open end. In some embodiments, the first radiation element 670 further includes a first rectangular widening portion 675 positioned at the second end 672. The second radiation element 680 may substantially have a C-shape. The second radiation element 680 has a first end 681 and a second end 682. The first end 681 of the second radiation element 680 is coupled to the shorting element 660 and the first end 671 of the first radiation element 670. The second end 682 of the second radiation element 680 is an open end, which extends toward the grounding point GP. In some embodiments, the second radiation element 680 further includes a second rectangular widening portion 685 positioned between the first end 681 and the second end 682. The first rectangular widening portion 675 and the second rectangular widening portion 685 can provide additional current paths for the auxiliary antenna structure. According to practical measurements, such a design not only prevents the appearance metal element 620 from negatively affecting the radiation pattern of the millimeter-wave antenna array 610 but also increases the operation bandwidth of the auxiliary antenna structure of the communication device 600. Other features of the communication device 600 of FIG. 6 are similar to those of the communication device 100 of FIG. 1. Therefore, these embodiments can achieve similar levels of performance.

Figure 7:
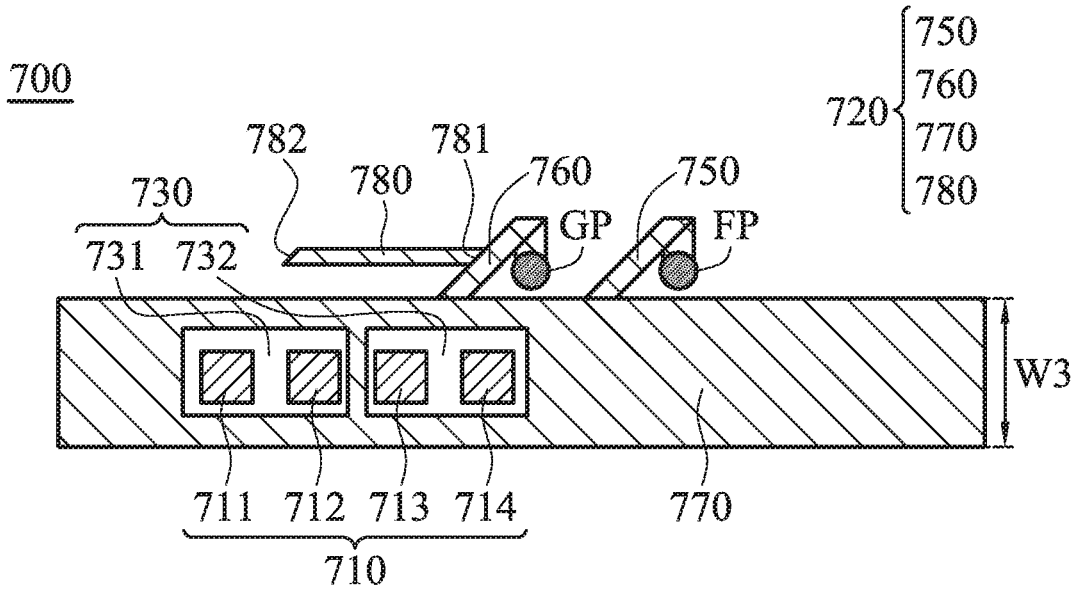
FIG. 7 is a top view of a communication device according to an embodiment of the invention.

FIG. 7 is a top view of a communication device 700 according to an embodiment of the invention. FIG. 7 is similar to FIG. 1. In the embodiment of FIG. 7, the communication device 700 includes a millimeter-wave antenna array 710 and an appearance metal element 720, and the appearance metal element 720 is used as an auxiliary antenna structure. In some embodiments, the auxiliary antenna structure is a sub-6 GHz antenna structure or a legacy antenna structure. The auxiliary antenna structure has a feeding point FP and a grounding point GP. The millimeter-wave antenna array 710 includes a first antenna element 711, a second antenna element 712, a third antenna element 713, and a fourth antenna element 714. The appearance metal element 720 has an antenna window 730. For example, the antenna window 730 may include a first opening 731 and a second opening 732, which are completely separate from each other. The first opening 731 is arranged for covering the whole vertical projections of the first antenna element 711 and the second antenna element 712. The second opening 732 is arranged for covering the whole vertical projections of the third antenna element 713 and the fourth antenna element 714. The shape of the antenna window 730 is adjusted according to the shape of the auxiliary antenna structure. Specifically, the appearance metal element 720 includes a feeding element 750, a shorting element 760, a main radiation element 770, and a tuning element 780. The feeding element 750 may substantially have a bending L-shape. The feeding element 750 is coupled to the feeding point FP. The shorting element 760 may substantially have a bending L-shape. The shorting element 760 is coupled to the grounding point GP. The main radiation element 770 may substantially have a rectangular shape, whose width W3 is the largest among all elements of the auxiliary antenna structure. The first opening 731 and the second opening 732 of the antenna window 730 are formed through the main radiation element 770. The tuning element 780 has a first end 781 and a second end 782. The first end 781 of the tuning element 780 is coupled to the shorting element 760. The second end 782 of the tuning element 780 is an open end, which extends away from the shorting element 760. The tuning element 780 can fine-tune the impedance matching of the auxiliary antenna structure, and it is optional and omitted in other embodiments. According to practical measurements, such a design not only prevents the appearance metal element 720 from negatively affecting the radiation pattern of the millimeter-wave antenna array 710 but also increases the operation bandwidth of the auxiliary antenna structure of the communication device 700. Other features of the communication device 700 of FIG. 7 are similar to those of the communication device 100 of FIG. 1. Therefore, these embodiments can achieve similar levels of performance.

Figure 8:
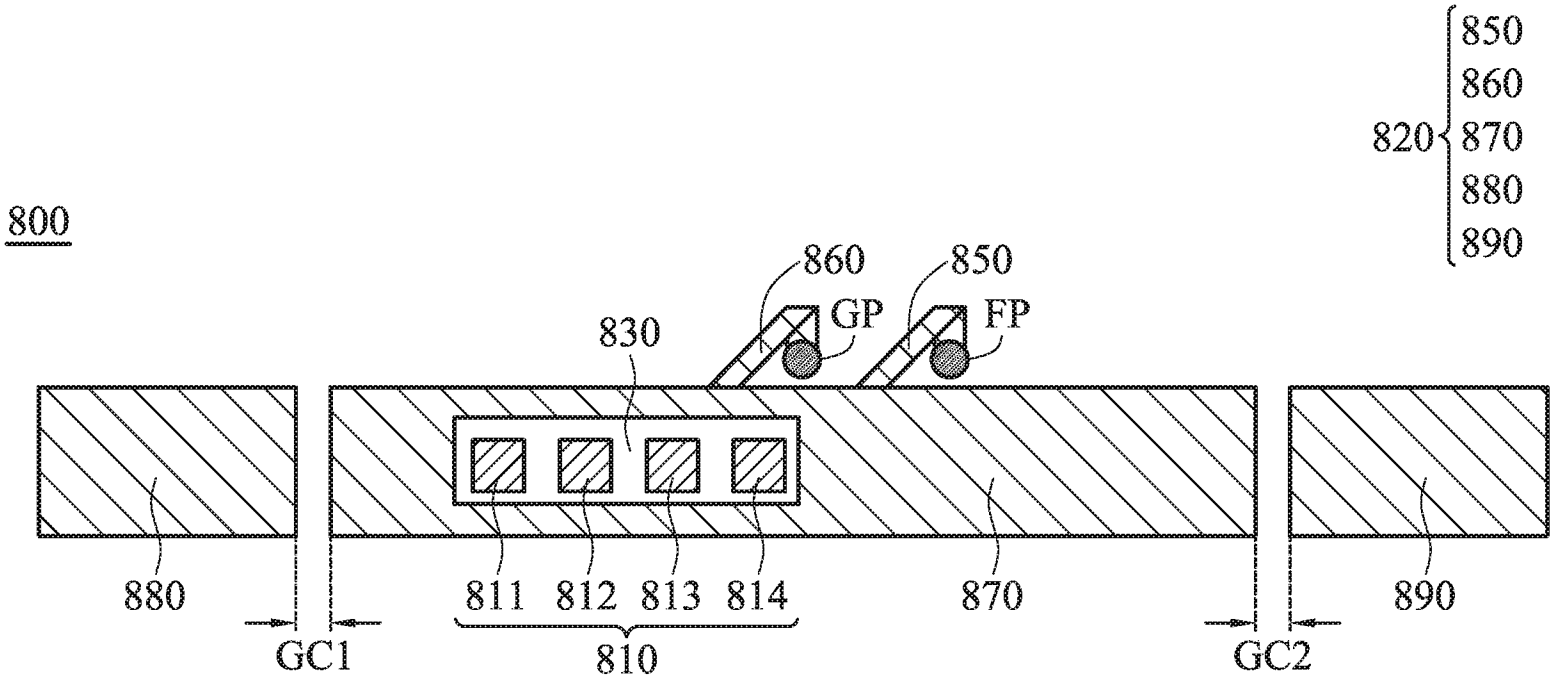
FIG. 8 is a top view of a communication device according to an embodiment of the invention.

FIG. 8 is a top view of a communication device 800 according to an embodiment of the invention. FIG. 8 is similar to FIG. 1. In the embodiment of FIG. 8, the communication device 800 includes a millimeter-wave antenna array 810 and an appearance metal element 820, and the appearance metal element 820 is used as an auxiliary antenna structure. In some embodiments, the auxiliary antenna structure is a sub-6 GHz antenna structure or a legacy antenna structure. The auxiliary antenna structure has a feeding point FP and a grounding point GP. The millimeter-wave antenna array 810 includes a first antenna element 811, a second antenna element 812, a third antenna element 813, and a fourth antenna element 814. The appearance metal element 820 has an antenna window 830. For example, the antenna window 830 may be substantially a rectangular opening for covering the whole vertical projection of the millimeter-wave antenna array 810. The shape of the antenna window 830 is adjusted according to the shape of the auxiliary antenna structure. Specifically, the appearance metal element 820 includes a feeding element 850, a shorting element 860, a main radiation element 870, a first additional radiation element 880, and a second additional radiation element 890. The feeding element 850 may substantially have a bending L-shape. The feeding element 850 is coupled to the feeding point FP. The shorting element 860 may substantially have a bending L-shape. The shorting element 860 is coupled to the grounding point GP. The main radiation element 870 may substantially have a rectangular shape. The antenna window 830 is formed through the main radiation element 870. The first additional radiation element 880 may substantially have a square shape or a rectangular shape. A first coupling gap GC1 is formed between the first additional radiation element 880 and the main radiation element 870. The second additional radiation element 890 may substantially have a square shape or a rectangular shape. A second coupling gap GC2 is formed between the second additional radiation element 890 and the main radiation element 870. The first additional radiation element 880 and the second additional radiation element 890 may be excited by the main radiation element 870 using a coupling mechanism, so as to fine-tune the impedance matching of the auxiliary antenna structure. According to practical measurements, such a design not only prevents the appearance metal element 820 from negatively affecting the radiation pattern of the millimeter-wave antenna array 810 but also increases the operation bandwidth of the auxiliary antenna structure of the communication device 800. Other features of the communication device 800 of FIG. 8 are similar to those of the communication device 100 of FIG. 1. Therefore, these embodiments can achieve similar levels of performance.

The invention proposes a novel communication device with a novel antenna design. In conclusion, the invention has at least the advantages of high gain, wide bandwidth, good radiation performance, and beautiful device appearance, and therefore it is suitable for application in a variety of mobile communication devices.

Note that the above element sizes, element shapes, and frequency ranges are not limitations of the invention. An antenna designer can fine-tune these settings or values according to different requirements. It should be understood that the communication device of the invention is not limited to the configurations of FIGS. 1-8. The invention may merely include any one or more features of any one or more embodiments of FIGS. 1-8. In other words, not all of the features displayed in the figures should be implemented in the communication device of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A communication device, comprising:
a millimeter-wave antenna array; and
an appearance metal element, having an antenna window;
wherein the millimeter-wave antenna array is configured to transmit or receive a wireless signal, and the wireless signal is transferred through the antenna window of the appearance metal element;
wherein the appearance metal element is used as an auxiliary antenna structure.

2. The communication device as claimed in claim 1, wherein the communication device is a mobile phone, a tablet computer, or a notebook computer.

3. The communication device as claimed in claim 1, wherein the appearance metal element is a frame, a bezel, a ring, or a back cover of the communication device.

4. The communication device as claimed in claim 1, wherein a radiation direction of the millimeter-wave antenna array is toward the antenna window.

5. The communication device as claimed in claim 1, wherein the millimeter-wave antenna array is configured to generate end-fire radiation.

6. The communication device as claimed in claim 1, wherein the millimeter-wave antenna array is disposed on a PCB (Printed Circuit Board).

7. The communication device as claimed in claim 1, wherein a shape of the antenna window is adjusted according to a shape of the millimeter-wave antenna array.

8. The communication device as claimed in claim 1, wherein the antenna window comprises at least one opening formed through the appearance metal element.

9. The communication device as claimed in claim 8, wherein the opening of the antenna window substantially has a square shape, a rectangular shape, a circular shape, a triangular shape, or an irregular shape.

10. The communication device as claimed in claim 8, wherein the millimeter-wave antenna array has a vertical projection on the appearance metal element, and the whole vertical projection is inside the opening.

11. The communication device as claimed in claim 1, wherein the antenna window comprises a first opening and a second opening formed through the appearance metal element, and the appearance metal element has a right-angle bending portion positioned between the first opening and the second opening.

12. The communication device as claimed in claim 11, wherein both the first opening and the second opening extend to an edge of the appearance metal element.

13. The communication device as claimed in claim 11, wherein neither the first opening nor the second opening touches any edge of the appearance metal element.

14. The communication device as claimed in claim 1, wherein the antenna window is filled with a nonconductive material.

15. The communication device as claimed in claim 14, wherein the nonconductive material is a plastic material, a glass material, or air.

16. The communication device as claimed in claim 1, wherein the antenna window substantially has a fence-shape.

17. The communication device as claimed in claim 16, wherein the antenna window comprises a plurality of hollow portions and a plurality of metal portions, and the hollow portions and the metal portions are interleaved with each other.

18. The communication device as claimed in claim 1, wherein the auxiliary antenna structure is a sub-6 GHz antenna structure or a legacy antenna structure.

19. The communication device as claimed in claim 1, wherein a shape of the antenna window is adjusted according to a shape of the auxiliary antenna structure.

20. A communication device, comprising:
a millimeter-wave antenna array; and
an appearance metal element, having an antenna window;
wherein the millimeter-wave antenna array is configured to transmit or receive a wireless signal, and the wireless signal is transferred through the antenna window of the appearance metal element;
wherein the antenna window comprises at least one opening formed through the appearance metal element;

wherein the millimeter-wave antenna array has a vertical projection on the appearance metal element, and the whole vertical projection is inside the opening.

* * * * *